United States Patent [19]

Gobush

[11] Patent Number: 4,960,283

[45] Date of Patent: Oct. 2, 1990

[54] MULTIPLE DIMPLE GOLF BALL

[75] Inventor: William Gobush, North Dartmouth, Mass.

[73] Assignee: Acushnet Company, New Bedford, Mass.

[21] Appl. No.: 411,749

[22] Filed: Sep. 25, 1989

Related U.S. Application Data

[60] Division of Ser. No. 257,283, Oct. 13, 1988, which is a division of Ser. No. 43,218, Apr. 27, 1987, Pat. No. 4,804,189, which is a continuation-in-part of Ser. No. 18,840, Feb. 24, 1987, abandoned, which is a continuation of Ser. No. 544,780, Oct. 24, 1983, abandoned.

[51] Int. Cl.[5] ..... A63B 37/14

[52] U.S. Cl. ..... 273/232; 273/227

[58] Field of Search ..... 273/232

[56] References Cited

U.S. PATENT DOCUMENTS

| | | | |
|---|---|---|---|
| 4,142,727 | 3/1979 | Shaw | 273/232 |
| 4,346,898 | 8/1982 | Badke | 273/232 |

FOREIGN PATENT DOCUMENTS

| | | | |
|---|---|---|---|
| 1381897 | 1/1975 | United Kingdom | 273/232 |
| 2117252 | 10/1983 | United Kingdom | 273/232 |

*Primary Examiner*—George J. Marlo

*Attorney, Agent, or Firm*—Lucas & Just

[57] ABSTRACT

The multiple dimpled golf ball has 78% or more of its surface covered with dimples. For a golf ball with a total of 414 dimples, 144 dimples have a diameter of 0.14 inches and 270 dimples have a diameter of 0.15 inches. If no dimples are removed from the poles, then the golf ball has 422 dimples.

3 Claims, 8 Drawing Sheets

MULTIPLE DIMPLE GOLF BALL

This is a division of application Ser. No. 257,283 filed Oct. 13, 1988 which, in turn, is a division of application Ser. No. 043,218 filed Apr. 27, 1987, now U.S. Pat. No. 4,804,189 issued Feb. 14, 1989.

Application Ser. No. 043,218 was a continuation-in-part of application Ser. No. 018,840 filed Feb. 24, 1987, now abandoned which, in turn, was a continuation of application Ser. No. 544,780 filed Oct. 24, 19883, now abandoned.

The present invention relates to golf balls and is particularly concerned with the production of golf balls that travel farther than golf balls now on the market without violating any of the rules promulgated by the U.S. Golf Association (USGA). This is made possible by covering more than 78% of the surface of the golf ball with dimples.

Since the dawn of golf, attempts have been made to improve the distance a golf ball will travel, and this is especially true over the last decade.

The USGA promulgates rules for the game of golf which include specifications for the golf ball itself. Compliance with USGA rules is not obligatory and indeed some companies actually allege that they sell "hot" balls that violate USGA rules. Any major manufacturer of golf balls could easily make a "hot" ball which violates the USGA rules; however, all respectable manufacturers adhere to the USGA rules religiously since violation of a rule can result in the ball being banned from all USGA play. There are three performance tests for golf balls imposed by the USGA, one being velocity, another relating to golf ball symmetry, and the third being an overall distance.

The velocity requirement, commonly referred to as the maximum initial velocity, specifies that the golf ball may not exceed a velocity of 250 feet per second when measured on apparatus approved by the USGA. There is a 2% tolerance on the velocity, i.e. the highest permissible velocity is 255 feet per second. Most manufacturers have a safety factor and make their average maximum velocity at some lesser value such as in the 2501 ∝ 253 range to minimize the risk of being declared "illegal".

The rule relating to golf ball symmetry simply states that the golf ball shall be designed and manufactured to perform in general as if it were spherically symmetrical. It is generally accepted that golf balls with substantially uniform dimple clusters will meet the USGA test but that golf balls with non-uniform dimple clusters will not. One example of a golf ball with substantially uniform dimple clusters is shown in British Patent No. 1,381,897 in which all dimples have substantially the same diameter and depth and are substantially uniformly spaced over the surface of the ball. Another example of a golf ball with substantially uniform dimple clusters is U.S. Pat. No. 4,142,727. While this patent teaches dimples of different dimensions and different spacings, there are 12 substantially uniform dimple clusters. An example of a golf ball with non-uniform dimple clusters is U.S. Pat. No. 3,819,190 wherein the dimples at the poles are substantially different from those which cover the rest of the surface of the ball.

The total overall distance is measured by a test known as the Overall Distance Standard and is 280 yards plus a tolerance of 6% (for a total permissible distance of 296.8 yards). There is talk within the industry that the tolerance will be lowered to 4%, i.e. total permissible distance of 291.2 yards. The Overall Distance Standard is a measurement of carry and roll. Carry is the distance from the tee to the point where the golf ball first impacts with the ground while carry and roll is the total distance from the tee to the point where the ball finally comes to rest. The Overall Distance Standard is tested on apparatus approved by the USGA on the outdoor range at the USGA Headquarters. This apparatus is intended to simulate a club known as a driver. Whether the tolerance is 6% or 4%, to the best of the knowledge of the applicants no one has been able to even come close to approaching the total permissible distance of the Overall Distance Standard while still having a size, weight and initial velocity which fall within the USGA Standards.

While the Overall Distance Standard is the norm used by the USGA, the industry frequently uses a distance standard that takes into account the overall distance (carry and roll) of a ball hit successively with a driver and a #5 iron. It is still necessary that such a golf ball comply with the USGA standard; however, since the USGA apparatus simulates a hit with a driver, two balls that have essentially the same overall distance on the USGA machine can have substantially different values in the drive plus #5 iron test. It has been found that there is a trade-off in manufacturing golf balls between a ball that has a good overall distance when hit with a driver and a ball that has a good overall distance when hit with a #5 iron. In other words, a golf ball manufactured to have a good overall distance when hit with a driver will generally have a poorer overall distance when hit with a #5 iron than a golf ball that is manufactured to have a good overall distance when hit with a #5 iron and vice versa.

There is a constant need within the golf ball industry to produce a golf ball with good overall distance when hit with both a #5 iron and a driver.

It has been found that distance is related to the aerodynamic characteristics of the golf ball and, more particularly, to the number of dimples, the dimple spacing, the dimple depth and the dimple diameter. It has also been found that dimple spacing is very important. To quantify dimple spacing, reference may be made to the percentage of the ball's surface area which is covered by dimples. Prior art patents (see for example U.S. Pat. No. 878,254) teach that golf balls have 25 to 75% of their surface area covered by dimples and at the present time, no balls have more than about 75.5% of their surface area covered by dimples. Another way to categorize the percentage of space taken up by the dimples on the surface of the golf balls is to refer to the land area between the dimples, which is often referred to as fret.

The applicants have now discovered that if the total surface area of the golf ball covered with dimples exceeds 78%, the golf ball will have substantially greater distance with a #5 iron and with a driver for both carry and carry plus roll.

One way to achieve covering more than 78% of the surface of the golf ball with dimples is to employ dimples of different diameters on the surface of the golf ball and specifically, it has been found that by employing five sets of dimple patterns, this goal is obtained. These five sets comprise four sets of a dual dimple pattern having a total of 324, 384, 414 or 484 dimples and a triple dimple pattern having a total of 484 dimples. In all cases, the dimples are substantially evenly spaced over the surface of the golf ball.

A golf ball with 324 dimples is prepared by laying out an icosahedron pattern on the surface of the golf ball and making substantially equilateral spherical triangles sufficient to yield 332 vertices, each vertex being the center of a dimple. If this icosahedron/spherical triangle procedure is used to form 332 vertices, there will be 332 points at which dimples can be placed and these will be substantially equally spaced over the surface of the golf ball. Removal of four dimples at each pole, three for a trademark and the other for an identifying number, gives the preferred number of 324 dimples. Additionally, other minor changes can be made in the layout of the dimples as previously discussed. For the golf ball with 324 dimples there are 124 dimples with a diameter of about 0.157 inches ±0.002 inches and the remaining 200 dimples have a diameter of about 0.170 inches ±0.002 inches.

A golf ball with 384 dimples is prepared by laying out an icosahedron pattern on the surface of the golf ball and making substantially equilateral spherical triangles sufficient to yield 392 vertices, each vertex being the center of a dimple. Laying out of dimple centers on golf balls in this manner is disclosed, for example, in British Patent No. 1,381,897. If this icosahedron/spherical triangle procedure is used to form 392 vertices, there will be 392 points at which dimples can be placed and these will be substantially equally spaced over the surface of the golf ball. It is generally considered desirable in top grade golf balls to remove four dimples at each pole, three for application of a trademark and the other for application of an identifying number. This gives the preferred number of dimples of 384 dimples. In addition to removal of dimples for the trademark if desired, other minor changes can be made in the layout of the dimples, e.g. separation of the dimples at the parting line of the golf ball mold to facilitate buffing of the parting line. For the golf ball with 384 dimples there are 144 dimples with a diameter of about 0.140 inches ±0.002 inches and the remaining 240 dimples have a diameter of about 0.160 inches ±0.002 inches.

A ball with 414 dimples is prepared by laying out an icosahedron pattern on the surface of the golf ball and making substantially equilateral spherical triangles sufficient to yield 422 vertices, each vertex being the center of a dimple. If this icosahedron/spherical triangular procedure is used to form 422 vertices, there will be 422 points at which dimples can be placed and these will be substantially equally spaced over the surface of the golf ball. Removal of four dimples at each pole, three for a trademark and the other for an identifying number, gives the preferred number of 414 dimples. For this layout, 144 dimples have a diameter of about 0.140 inches ±0.002 inches and the remaining 270 dimples have a diameter of about 0.150 inches ±0.002 inches.

For golf balls with a total of 484 dimples with either two different dimple diameters or three different dimple diameters, an icosahedron pattern is laid out on the surface of the golf ball making substantially equilateral spherical triangles sufficient to yield 492 vertices, each vertex being the center of a dimple. In this icosahedron/spherical triangle procedure there will be 492 points at which dimples can be placed and these will be substantially equally spaced over the surface of the golf ball. As with the 324, 384 and 414 patterns, removal of four dimples at each pole, three for a trademark and the other for an identification number gives the preferred number of 484 dimples. For a dual dimple pattern there are 174 dimples with a diameter of about 0.130 inches and 310 dimples with a diameter of about 0.140 inches ±0.002 inches. For the three different diametered dimples, there are 170 dimples with a diameter of about 0.130 inches ±0.002 inches, 260 dimples with a diameter of about 0.140 inches ±0.002 inches and 50 dimples with a diameter of about 0.150 inches ±0.002 inches.

In the four dual dimple patterns the smaller diametered dimples are arranged along the edges and vertex centers of the icosahedron while the larger dimples are arranged inside the triangles formed by the smaller dimples. In the 484 pattern with three different dimple diameters, the medium sized dimples with diameters of about 0.140 inches ±0.002 inches are arranged such that they form a similar triangle just inside the individual triangles formed by the smaller dimples. The largest diametered dimples, of which there are three per individual triangle, form a triangle inside the medium sized dimples.

These dimple patterns produce a golf ball with very little land area between adjacent dimples. The present invention has been found to have a ball with at least about 78% of the surface area of the ball covered by dimples and preferably above about 79%.

FIG. 1 A illustrates a hemisphere of a golf ball according to the present invention with a dual dimple configuration for a 324 pattern.

FIG. 1 B illustrates a hemisphere of a golf ball according to the present invention with a dual dimple for a 384 pattern.

FIG. 1 C illustrates a hemisphere for a golf ball according to the present invention with a dual dimple configuration for a 414 pattern.

FIG. 1 D illustrates a hemisphere for a golf ball according to the present invention with a dual dimple configuration for a 484 pattern.

Figure 1A:
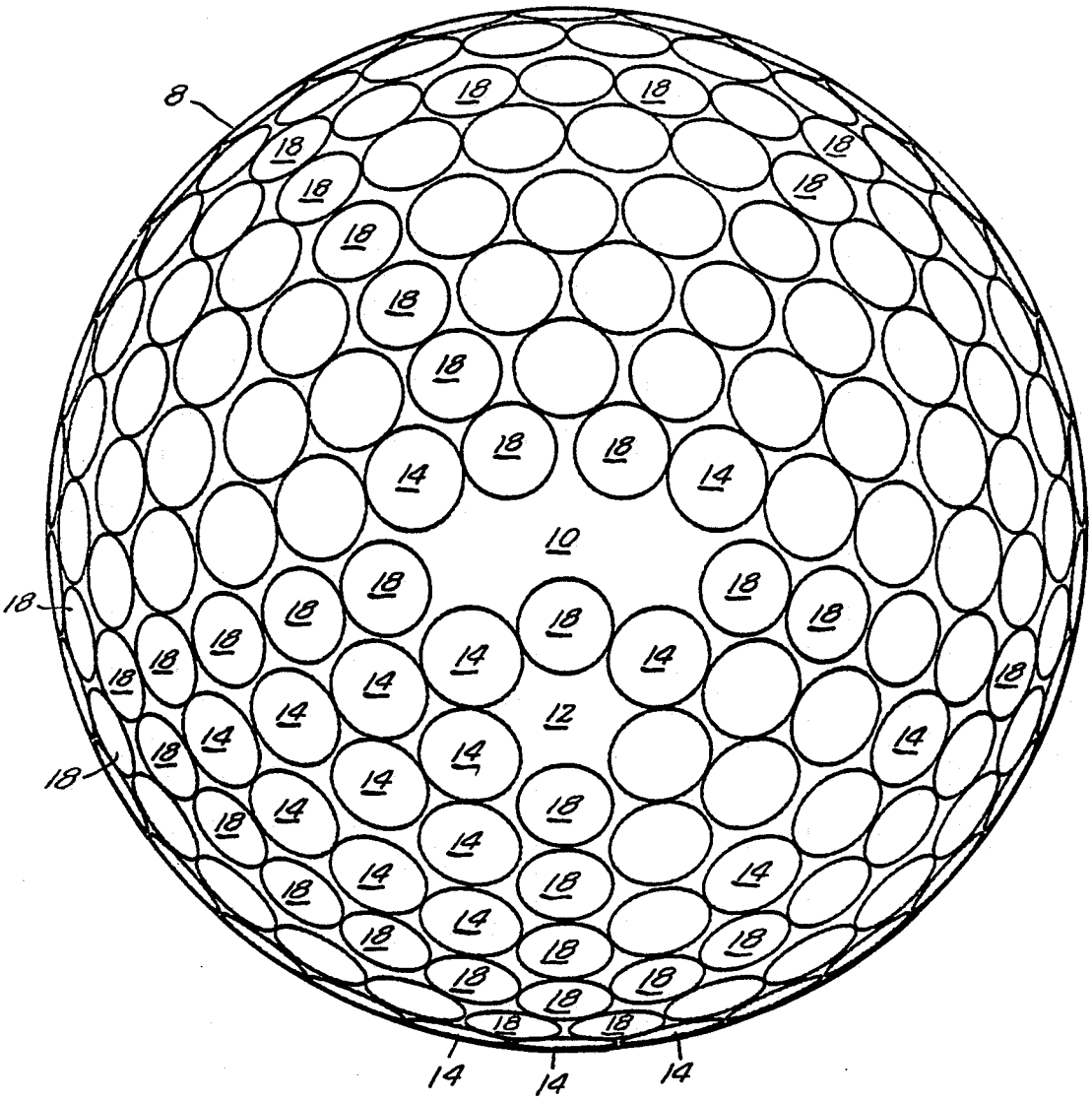
Figure 1B:
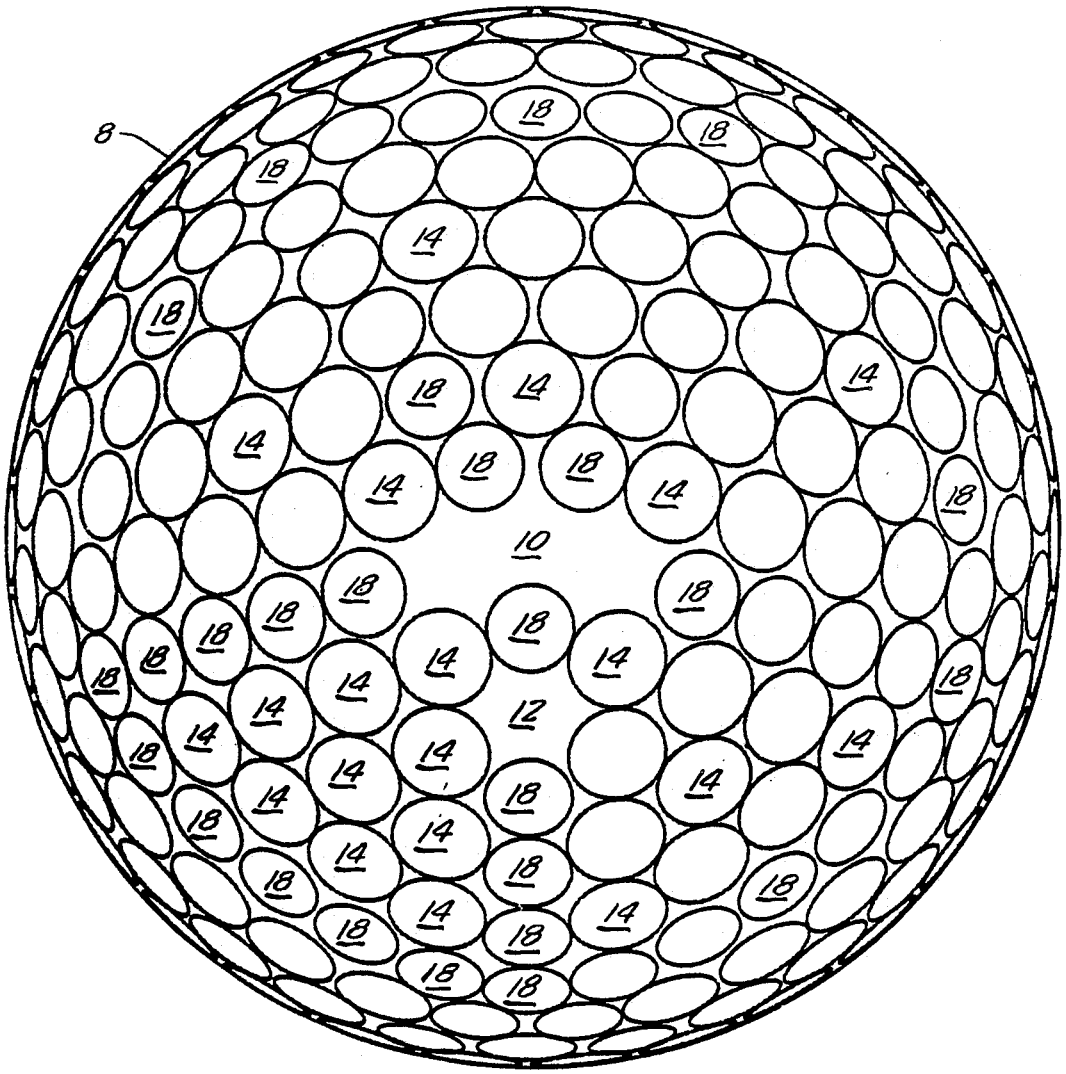
Figure 1C:
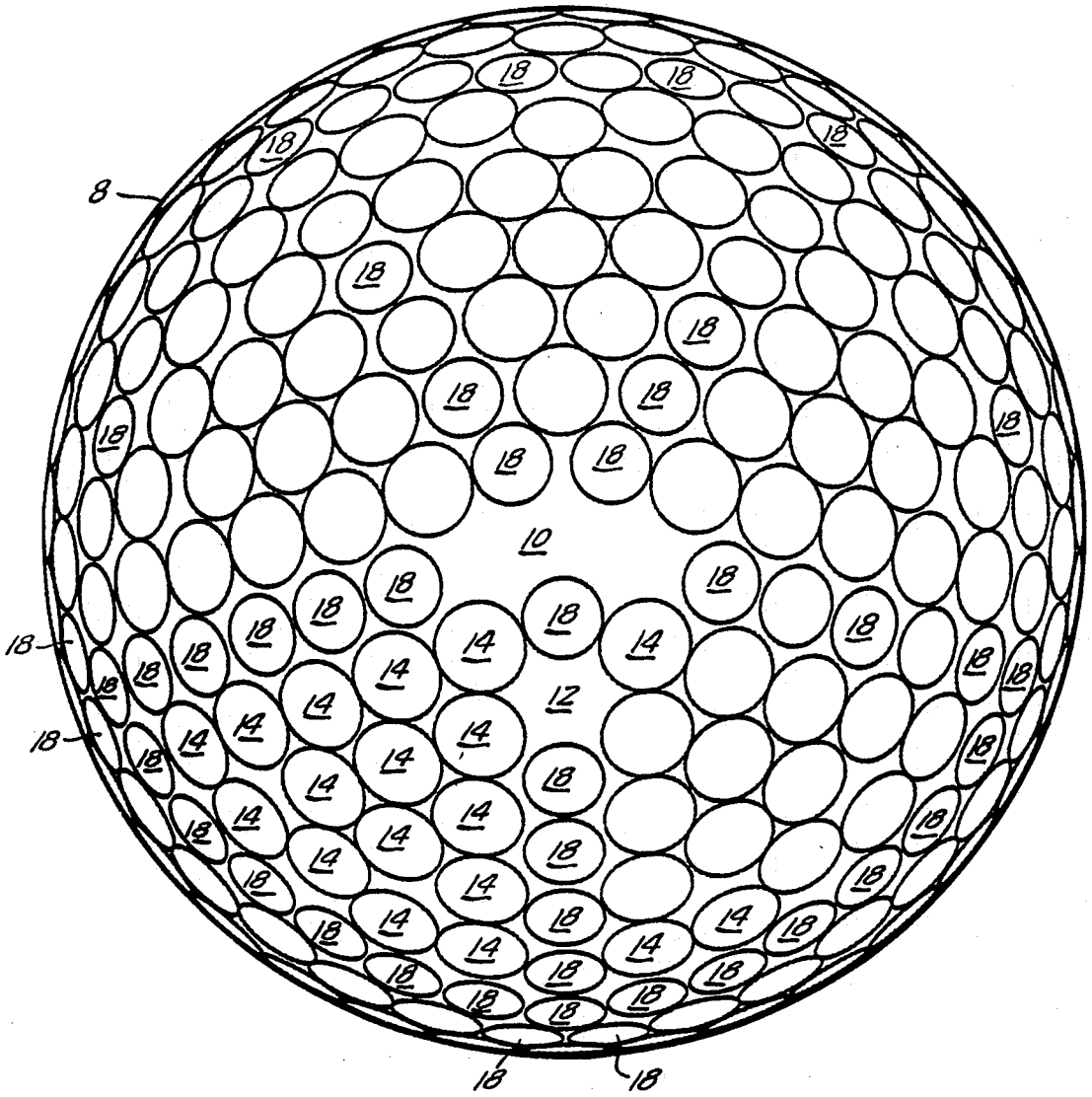
Figure 1D:
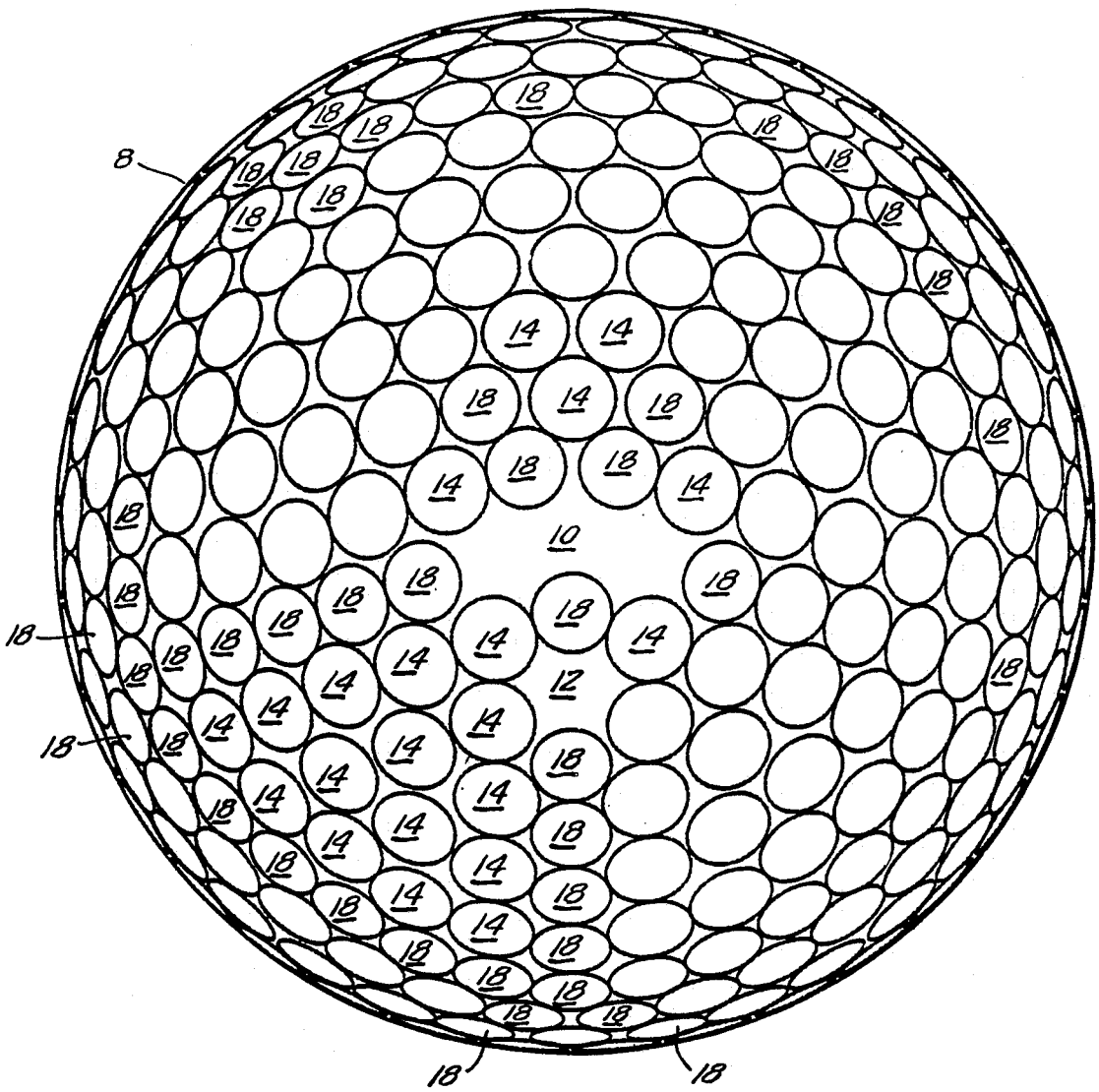

In FIG. 1A, the dimples are laid out in an icosahedron/ spherical triangular pattern as described hereinbefore. The outer periphery is the equator 8 of the ball. In accordance with the present invention, area 10 at the pole of the ball is a smooth surface for application of a trademark. Area 12 is similarly smooth for application of an identifying number. Dimples 14 are the larger size dimples, i.e. about 0.170 inches, while dimples 18 are dimples of the smaller diameter, i.e. about 0.157 inches.

In FIG. 1 B, the dimples are laid out in an icosahedron/ spherical triangular pattern as described hereinbefore. The outer periphery is the equator 8 of the ball. In accordance with the present invention, area 10 at the pole of the ball is a smooth surface for application of a trademark. Area 12 is similarly smooth for application of an identifying number. Dimples 14 are the larger size dimples, i.e. about 0.160 inches, while dimples 18 are dimples of the smaller diameter, i.e. about 0.140 inches.

In FIG. 1 C, the dimples are laid out in an icosahedron/ spherical triangular pattern as described hereinbefore. The outer periphery is the equator 8 of the ball. In accordance with the present invention, area 10 at the pole of the ball is a smooth surface for application of a trademark. Area 12 is similarly smooth for application of an identifying number. Dimples 14 are the larger size dimples, i.e. about 0.15 inches while dimples 18 are of smaller diameter, i.e. about 0.140 inches.

In FIG. 1 D, the dimples are laid out in an icosahedron/ spherical triangular pattern as described hereinbefore. The outer periphery is the equator 8 of the ball. In accordance with the present invention, area 10 at the pole of the ball is a smooth surface for application of a trademark. Area 12 is similarly smooth for application of an identifying number. Dimples 14 are the larger size dimples, i.e. about 0.140 inches, while dimples 18 are dimples of the smaller diameter, i.e. about 0.130 inches.

Figure 2:
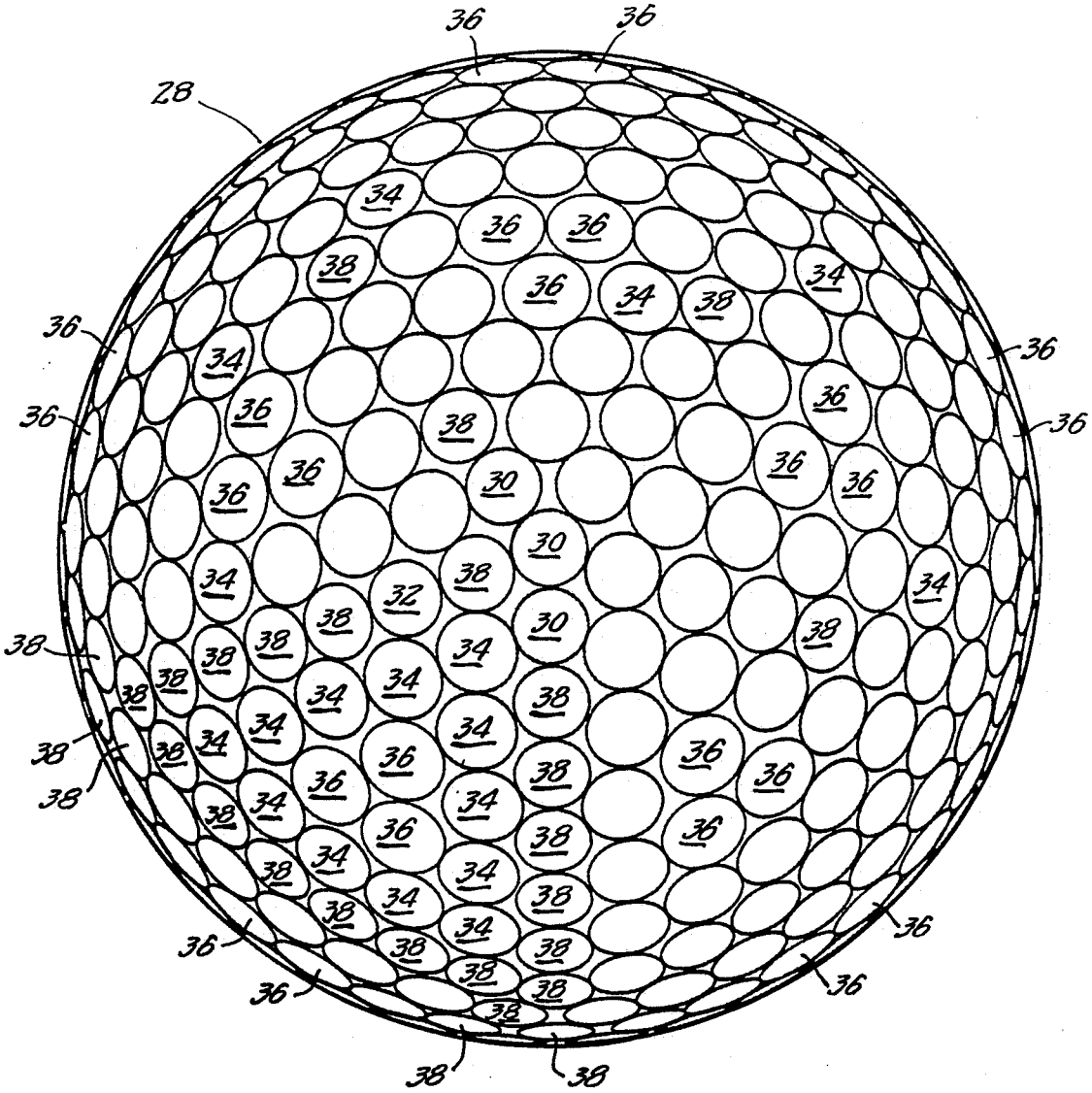
FIG. 2 illustrates a hemisphere of a golf ball according to the present invention for a triple dimple pattern for 484 pattern.

In FIG. 2, the dimples are laid out in an icosahedron/spherical triangular pattern as described hereinbefore for a 484 triple dimple pattern. The outer periphery is the equator 28 of the ball. In accordance with the present invention, dimples 30 at the pole of the ball can be absent to make a smooth surface for a trademark. Dimples 32 can similarly be absent for an identifying number. Dimples 34 and 36 are the larger sized dimples. In the triple dimple configuration of the 484 pattern, dimples 34 are about 0.140 inches in diameter and dimples 36 are about 0.150 inches in diameter and dimples 38 are the smallest sized dimple, i.e. about 0.130 inches in diameter.

These and other aspects of the present invention may be more fully understood with respect to the following examples.

EXAMPLE 1

A golf ball made in accordance with the present invention with a total of 384 dimples having 144 smaller dimples of about 0.140 inches in diameter and a depth of 0.0110 inches and having 240 larger dimples of about 0.160 inches in diameter and a depth of 0.0110 inches was tested against a conventional golf ball with 384 dimples, all being about 0.150 inches in diameter and a depth of 0.0115 inches. Both balls were two piece balls with a core and a cover. The core was made from polybutadiene crosslinked by zinc diacrylate.

Carry distance and total distance (carry and roll) were determined in a field test using an apparatus commonly referred to in the golf ball industry as a dual pendulum machine. The dual pendulum machine has a pendulum on each side of a motor which swings the pendulums so that they hit two golf balls simultaneously, one with each pendulum. The balls are tested at a temperature of about 70° F. Two balls at a time are then hit by the pendulums into an open field where carry distance and total distance are individually sighted and recorded by workers. A series of eight balls is hit on each side of the machine. At the end of the run, the balls were collected and returned to the machine. They were sorted and then reversed as to the pendulum by which they were hit. Measurements were again made, the balls collected and this procedure was repeated. There was a total of 32 hits for each type of ball, i.e. each of the eight individual balls was hit four times, twice on each side of the dual pendulum machine.

The procedure just described was used for distance testing of both the driver and the #5 iron. The dual pendulum has an adjustable striking face. In order to duplicate a driver, a 13.9° launch angle was used. A 13.9° launch angle is achieved by using a striking face having an angle of 15° with respect to the vertical. In order to duplicate a #5 iron, a 22° launch angle was used. A 22° launch angle is achieved by using a striking face having an angle of 26° with respect to the vertical. The results of the distance tests are as follows:

TABLE I

| | Ball of Invention | | Prior Art | |
|---|---|---|---|---|
| Diameter (in.) | 1.68 | | 1.68 | |
| Weight (oz.) | 1.605 | | 1.605 | |
| PGA Compression | 94 | | 95 | |
| Initial Velocity (ft/sec) | 253.08 | | 252.71 | |
| Dimple Dimensions (in.) | Large | Small | | |
| Theoretical Diameter | 0.160 | 0.140 | 0.150 | |
| Actual Diameter | 0.1597 | 0.1367 | 0.1474 | |
| Actual Depth | 0.0108 | 0.0110 | 0.0115 | |
| % of Ball Surface covered by dimples | | | | |
| Theoretical | 79.4 | | 76.5 | |
| Actual | 78.1 | | 73.9 | |
| Distance (yds.) | Carry | Carry + Roll | Carry | Carry + Roll |
| Driver | 198.4 | 209.0 | 195.2 | 204.8 |
| 5-iron | 168.9 | 171.3 | 166.8 | 169.4 |
| Total | 367.3 | 380.3 | 362.0 | 374.2 |

It is readily apparent that the dual dimple golf ball has a better overall distance with both a #5 iron and with a driver than a conventional golf ball. This is truly surprising and unexpected because, in general, a ball which exhibits improved overall distance with a driver does not show an improved overall distance with a #5 iron, and vice versa, as previously disclosed hereinabove.

EXAMPLE 2

In this example, golf balls with a dual dimple diameter pattern were live tested against conventional golf balls in which all of the dimples had the same diameter. Twelve live golfers instead of the apparatus referred to in Example 1 as a dual pendulum machine were used to hit the balls. Both sets of balls were two piece balls with solid cores made from polybutadiene crosslinked with zinc diacrylate. Each one of the balls had 384 dimples. Physical data on each of the balls are listed in Table II below as well as the results of two days of distance testing.

TABLE II

| | Ball of Invention | | Prior Art | |
|---|---|---|---|---|
| Diameter (in.) | 1.68 | | 1.68 | |
| Weight (oz.) | 1.60 | | 1.60 | |
| PGA Compression | 100.2 | | 97.8 | |
| Initial Velocity (ft/sec) | 253.12 | | 253.17 | |
| Dimple Dimensions (in.) | Large | Small | | |
| Theoretical Diameter | 0.160 | 0.140 | 0.150 | |
| Actual Diameter | 0.1597 | 0.1367 | 0.1468 | |
| Actual Depth | 0.0108 | 0.0110 | 0.0110 | |
| % of Ball Surface covered by dimples | | | | |
| Theoretical | 79.4 | | 76.5 | |
| Actual | 78.1 | | 73.3 | |
| Distance (yds.) | Carry | Carry + Roll | Carry | Carry + Roll |

TABLE II-continued

| | | | | |
|---|---|---|---|---|
| Driver | 190.2 | 204.6 | 188.4 | 203.7 |
| 5-iron | 156.5 | 164.9 | 154.6 | 162.8 |
| Total | 346.7 | 369.5 | 343.0 | 366.5 |

It is readily apparent that the dual dimple golf ball outperformed the conventional golf balls by about 3.0 yards.

EXAMPLE 3

A dual dimple golf ball was tested against two conventional golf balls using live golfers to hit the balls instead of a dual pendulum machine. All balls were two piece golf balls with solid rubber cores made from polybutadiene crosslinked with zinc diacrylate. All balls had 384 dimples. Table III below lists both the physical characteristics of the golf balls as well as the results of two days worth of distance testing.

TABLE III

| | Ball of Invention | | Prior Art (1) | | Prior Art (2) | |
|---|---|---|---|---|---|---|
| Diameter (in.) | 1.68 | | 1.68 | | 1.68 | |
| Weight (oz.) | 1.60 | | 1.60 | | 1.60 | |
| PGA Compression | 94 | | 95 | | 95 | |
| Initial Velocity (ft/sec) | 253.52 | | 253.08 | | 253.08 | |
| Dimple Dimensions (in.) | Large | Small | | | | |
| Theoretical Diameter | 0.160 | 0.140 | 0.150 | | 0.150 | |
| Actual Diameter | 0.1590 | 0.1371 | 0.1479 | | 0.1480 | |
| Actual Depth | 0.0108 | 0.0109 | 0.0118 | | 0.0108 | |
| % of Ball Surface covered by dimples | | | | | | |
| Theoretical | 79.4 | | 76.5 | | 76.5 | |
| Actual | 77.7 | | 74.4 | | 74.5 | |
| Distance (yds.) | Carry | Carry + Roll | Carry | Carry + Roll | Carry | Carry + Roll |
| Driver | 191.3 | 207.0 | 186.3 | 203.0 | 188.6 | 206.9 |
| 5-iron | 163.4 | 172.1 | 159.9 | 167.9 | 157.7 | 165.3 |
| Total | 354.7 | 379.1 | 346.2 | 370.9 | 346.3 | 372.2 |

It is apparent that the dual dimple golf ball travelled farther than any of the conventional single dimple golf balls.

EXAMPLE 4

A dual dimple golf ball was tested against a conventional golf ball using live golfers. All golf balls were manufactured from a two piece golf ball with a solid rubber core made from polybutadiene crosslinked with zinc diacrylate. All balls had 384 dimples. Table IV lists both the physical characteristics of the golf balls and the distance results after two days of testing.

TABLE IV

| | Ball of Invention | | Prior Art |
|---|---|---|---|
| Diameter (in.) | 1.68 | | 1.68 |
| Weight (oz.) | 1.60 | | 1.60 |
| PGA Compression | 94.9 | | 95.6 |
| Initial Velocity (ft/sec) | 253.78 | | 252.53 |
| Dimple Dimensions (in.) | Large | Small | |
| Theoretical Diameter | 0.160 | 0.140 | 0.15 |
| Actual Diameter | 0.1590 | 0.1371 | 0.1490 |
| Actual Depth | 0.0108 | 0.0109 | 0.0116 |

TABLE IV-continued

| | | | | |
|---|---|---|---|---|
| % of Ball Surface covered by dimples | | | | |
| Theoretical | 79.4 | | 76.5 | |
| Actual | 77.7 | | 75.5 | |
| Distance (yds.) | Carry | Carry + Roll | Carry | Carry + Roll |
| Driver | 198.0 | 207.2 | 194.6 | 205.8 |
| 5-iron | 158.1 | 162.3 | 157.1 | 161.1 |
| Total | 356.1 | 369.5 | 351.7 | 366.9 |

It is apparent from the foregoing that a ball with superior distance is produced when a dual dimple pattern as disclosed herein is used.

EXAMPLE 5

In this example, different dimple patterns are compared for percent of surface coverage.

TABLE V

| Pattern Number | Total Number of Dimples | Number Dimples at Different Diameter | Dimple Diameter | Percent Dimple Coverage |
|---|---|---|---|---|
| 1 | 324 | 324 | 0.157 | 70.7 |
| 2 | 324 | 124 | 0.157 | |
| | | 200 | 0.170 | 78.3 |
| 3 | 384 | 384 | 0.146 | 72.5 |
| 4 | 384 | 144 | 0.140 | |
| | | 240 | 0.160 | 79.4 |
| 5 | 414 | 414 | 0.140 | 71.9 |
| 6 | 414 | 270 | 0.150 | |
| | | 144 | 0.140 | 78.8 |
| 7 | 484 | 484 | 0.130 | 72.5 |
| 8 | 484 | 174 | 0.130 | |
| | | 310 | 0.140 | 79.9 |
| 9 | 484 | 174 | 0.130 | |
| | | 260 | 0.140 | |
| | | 50 | 0.150 | 81.2 |

It is readily apparent that pattern of dual dimples provides at least 5% more dimple coverage than a single dimple pattern and that the three size dimple pattern provides at least a 1.3% increase in dimple coverage as compared to the duel dimple pattern.

EXAMPLE 6

A group of golf balls was obtained. The golf balls are made by the assignee of the instant invention and are sold under the trademark Titleist Pro Trajectory. These golf balls have a so-called liquid center which is well-known in the golf ball industry. The liquid center was formed from a hollow sphere which had an exterior diameter of 1-1/16 inches. The hollow sphere is completely filled with a liquid. The center is covered with elastic thread of dimension 0.22"×1/16" to a wound ball size of 1.610 inches in diameter. On top of that is molded a cover comprising the following ingredients:

| | |
|---|---|
| Resin | 76.2% |
| Resin composed of: | |
| Transpolyisoprene | 84% |
| Natural Rubber | 16% |
| Filler | 22.5% |
| Other | 1.3% |

The molded golf balls are treated and painted in standard manner. The diameter of the finished golf balls is 1.680 inches. It is pointed out that all diameters given are average values. Actual values may vary as much as 0.003 inches.

The golf balls have 324 dimples distributed uniformly over the surfaces of the golf ball with centers at the vertices of an icosahedron/spherical triangle arrangement as described in British Pat. No. 1,381,897, except that four vertices at each pole do not have dimples in order to provide a smooth surface for the trademark and identifying number and the vertices have been slightly rearranged at the equator to separate the dimples for the mold parting line. The dimples have a diameter of 0.146 inch ±0.002 inch and a depth of 0.0122 inch ±0.0003 inch.

EXAMPLE 6A

A group of golf balls was made in accordance with the teachings of U.S. application Ser. No. 018,840 filed Feb. 24, 1987. The golf balls had the same type of liquid filled center as the golf balls of Example 6 and were made using the same elastic thread as used in Example 6 and the wound ball diameter was the same 1.610 inches.

In this case, however, the golf balls were made to conform to the parameters of the '840 application. The size of the center was increased to 1⅛ inches. The cover composition molded onto the wound ball was changed to be 100% transpolyisoprene polymer as follows:

| | |
|---|---|
| Resin | 76.7% |
| Resin composed of: | |
| Transpolyisoprene | 100% |
| Natural Rubber | 0% |
| Filler | 22.0% |
| Other | 1.3% |

The composition of the Filler and the Other was the same as in Example 6 except that slightly less Filler was utilized. The molded balls were treated and painted in standard manner. The diameter of the finished balls was 1.680 inches. As with Example 6, diameter tolerance was up to 0.003 inch.

Further in accordance with the present invention, the golf balls had 384 dimples substantially evenly spaced over the surface of the golf ball utilizing an icosahedron/spherical triangle pattern as described for the golf balls of Example 6. As with the golf balls of Example 6, four vertices were not used for dimples in the area of each pole to provide a smooth surface for the trademark and identifying number and dimple vertices were slightly rearranged at the equator for the mold parting line. The dimples had a diameter of 0.146 inch ±0.002 inch and a depth of 0.0115 ±0.0003 inch.

Figure 6:
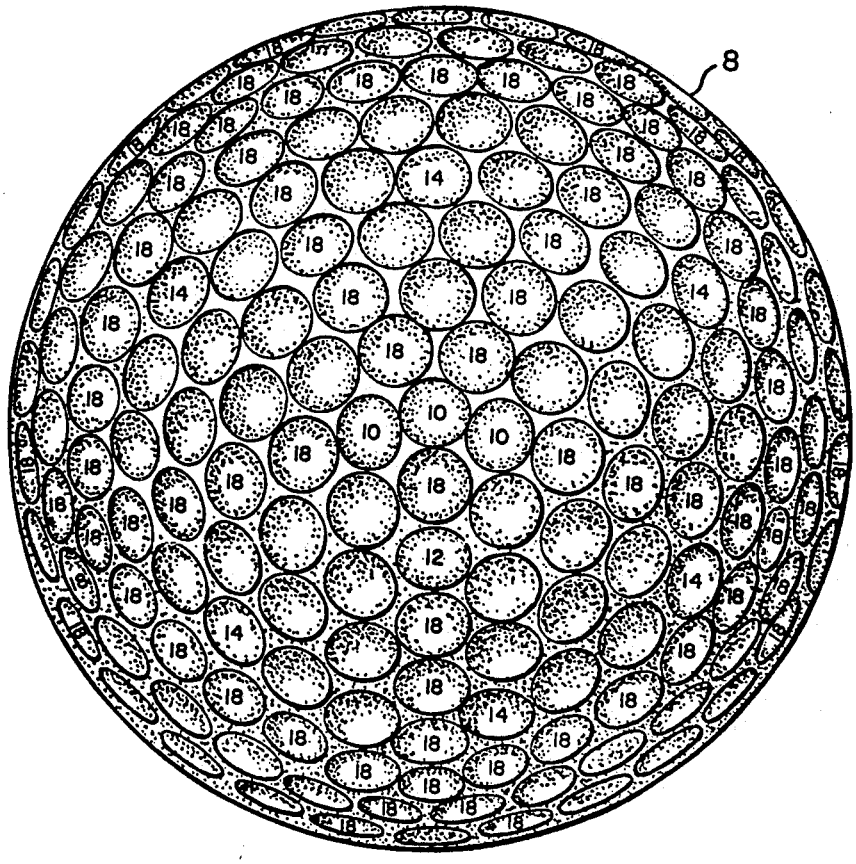
FIG. 6 illustrates a golf ball made in accordance with Example 6herein.

FIG. 6 illustrates golf ball made in accordance with this example. Golf ball 8 has dimples 10 and 12 which can be removed in order to affix a trademark and identification number. Dimples 18 are also shown.

COMPARATIVE TESTS

The finished golf balls of Examples 6 and 6A were compared for a number of properties. Balls were selected from each example which were statistically comparable for USGA standards, i.e. size, weight and initial velocity. Each ball selected had a weight of 1.610–1.620 ounces, a size of 1.680–1.690 inches, and an initial velocity of 2353.0–253.5 feet/second. These variations in size, weight and velocity have been found to be statistically insignificant for the number of balls tested. The balls were first analyzed for spin rate. This was done for both a driver and a #5 iron. A ball hit with a driver typically has a launch angle of 11° and a ball hit with a #5 iron typically has a launch angle of 21°. The spin rates were determined by machine tests at the indicated angles using an apparatus of the type disclosed in U.S. Pat. No. 4,063,259.

Carrying distance and total distance (carry and roll) were determined in a field test using an apparatus commonly referred to in the golf ball industry as a dual pendulum machine. The dual pendulum machine has a pendulum on each side of a motor which swings the pendulums so that they hit two golf balls simultaneously, one with each pendulum. The balls are conditioned at a temperature of 70° F. Two balls at a time are then hit by the pendulums into an open field where carry distance and total distance are individually sighted and recorded by workers. A series of eight balls is hit on each side of the machine. In this case, a series of eight balls of Example 6 was hit on one side of the machine and a series of eight balls of Example 6A was simultaneously hit on the other side. At the end of the run, the 16 balls were collected and returned to the machine. They were sorted and then reversed a to the pendulum by which they were hit. Measurements were again made, the balls were collected and this procedure was repeated twice more. This gives four hits for each of the eight balls of each of the examples, a total of 32 hits for the balls of each example, with 16 being hit by each pendulum. It has been found that this number of hits gives statistically significant results and virtually eliminates wind changes, temperature differences, machine or pendulum differences, etc., especially because balls of the two examples are hit simultaneously and are alternated as to the pendulum through the series of four tests.

The procedure just described was used for distance testing of both the driver and the #5 iron. The dual pendulum has an adjustable striking face. In order to duplicate a driver, an 11° Launch angle was used. An 11° launch angle is achieved by using a striking face having an angle of 13° with respect to the vertical. In order to duplicate a #5 iron, a 21° launch angle was used. A 21° launch angle is achieved by using a striking face having an angle of 26° with respect to the vertical. The results of the spin velocity and driving distance tests are as follows:

| | Example 6 Balls | Example 6 A Balls |
|---|---|---|
| Spin Velocity (rpm) | | |
| 11° | 3135 | 2799 |
| 21° | 5310 | 4788 |
| Carry Distance (Yards) | | |
| 11° | 251.3 | 253.7 |
| 21° | 168.8 | 172.3 |
| 11° + 21° | 420.1 | 426.0 |
| Total Distance (Carry + Roll) (yards) | | |
| 11° | 268.5 | 276.3 |
| 21° | 179.1 | 184.7 |
| 11° + 21° | 447.6 | 461.0 |

EXAMPLE 6B

Golf balls are made according to Example 6A except that the dimples marked 18 in FIG. 6 have a diameter of 0.140 inches ±0.002 inch, while the balance of the dimples have a diameter of 0.0160 inches ±0.002 inch. The average diameter of all the dimples was 0.151 inches ±0.002 inch. The spin rate of the golf balls is the same as that of Example 6A. In distance testing the balls of the present examples are statistically superior to the golf balls of Example 6A.

EXAMPLE 7

This example illustrates a second configuration for a golf ball made with 384 dimples with dimples of two different sizes.

The second configuration of 384 dual dimples has 66 dimples having a diameter of about 0.13 inches ±0.002 inches and 318 dimples having a diameter of about 0.160 inches ±0.002 inches.

The dimple pattern for this second configuration of 384 dimples is prepared by laying out an icosahedron pattern on the surface of the golf ball and making substantially equilateral spherical triangles sufficient to yield 392 vertices, each vertex being the center of a dimple. The process is similar to that used to lay out the 384 dual dimple ball having 144 dimples with a diameter of about 0.140 inches and 240 dimples with a diameter of about 0.160 inches. As with the 384 ball, preferably 4 dimples are removed at each pole, 3 for a trademark and 1 for an identification number.

In the second configuration for the 384 ball, the smaller dimples, about 0.13 inches, are positioned in groups of six at each vertex of the icosahedron. Specifically, one of the small dimples is placed directly at the vertex. Clustered around the small dimples at the vertex are five additional small dimples which are the immediate neighbors to the small dimple at the vertex. These six small dimples form a pentagonal arrangement.

Figure 3:
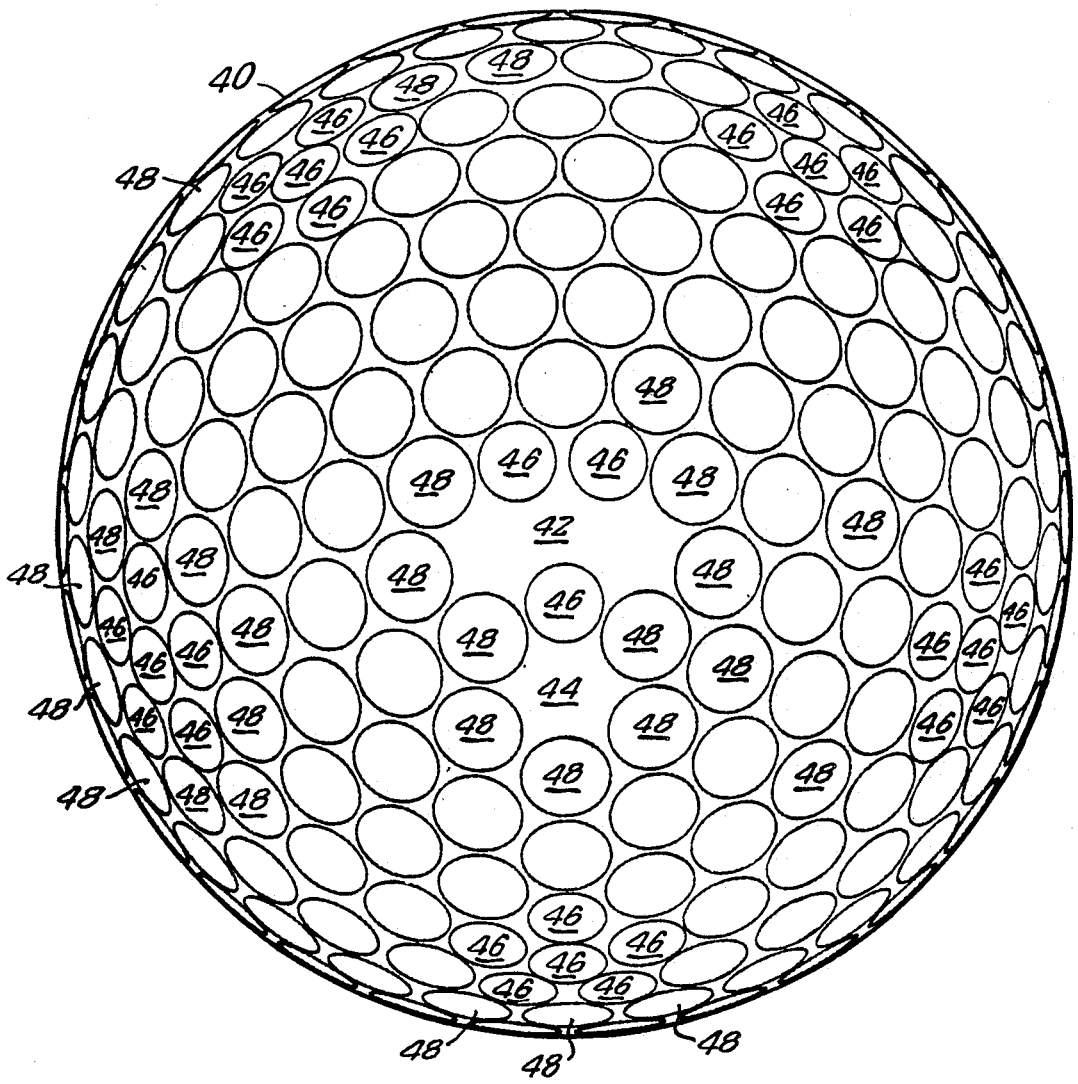
FIG. 3 illustrates a hemisphere of a golf ball according to the present invention with a dual dimple pattern as disclosed in Example 7 herein.

In FIG. 3 the dimples are laid out in accordance with this example. Outer periphery is the equator 40 of the ball. In accordance with this example, cleared area 42 exists which had three dimples removed therefrom for the purpose of affixing a trademark and area 44 had a dimple removed for the purpose of affixing an identification number. Dimples 46 are small dimples, i.e. about 0.13 inches ±0.002 inches and dimples 48 are larger dimples, i.e. about 0.16 inches ±0.002 inches.

It has been found that a golf ball having the second configuration of 384 dimples produces a ball having about 82% of its surface covered with dimples.

EXAMPLE 8

Yet another way to achieve covering more than 78% of the surface of a golf ball with dimples is to employ a pattern of triangularly shaped dimples with a total of 320 triangular dimples covering the ball. In fact, such an arrangement has been found to cover between about 81% to about 87% of the surface of the ball with dimples.

A ball with an icosahedron dimple pattern having 320 triangular dimples is prepared by laying out an icosahedron pattern on the surface of the ball by dividing its surface into twenty equal main triangles. Each main triangle is broken into sixteen smaller triangles by dividing the sides of the main triangle into four equal parts and joining the three points on each side with the arcs of great circles with neighboring sides. This process applied to all the 20 main triangles will produce three hundred and twenty small triangular areas and one hundred and sixty-two vertices. As with the other patterns, dimples can be removed for application of trademark and identification number.

The triangular dimples are arranged on the surface of the golf ball in such a manner that the fret line between adjacent dimples is maintained between about 0.015 inches and about 0.010 inches. The individual triangular dimples that are used to make up the dimples in this pattern are a combination of isosceles triangles, equilateral triangles, and triangles with no equal sides.

Figure 4:
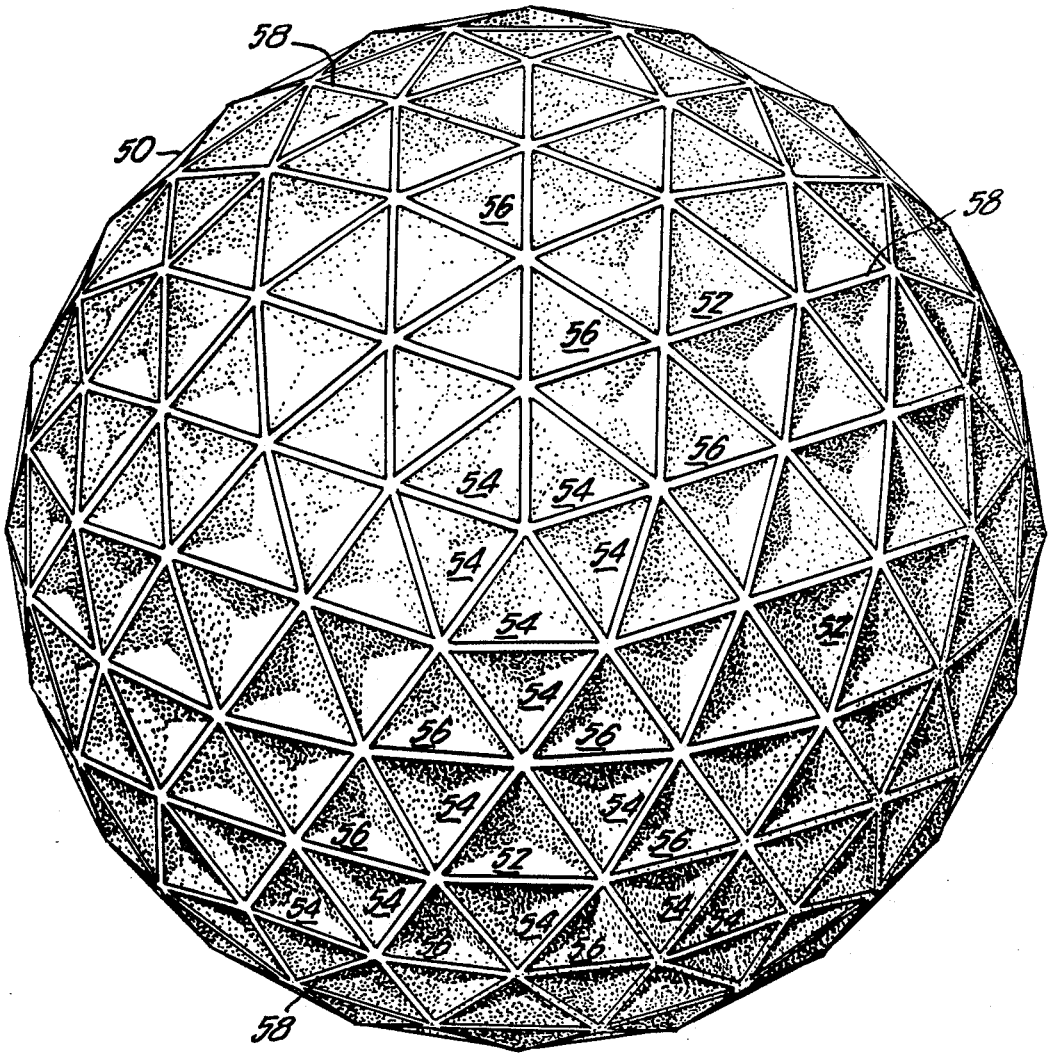
FIG. 4 illustrates a hemisphere of a golf ball according to the present invention with a triangular dimple shape as taught by Example 8 herein.

In FIG. 4, triangular dimples are laid out in an icosahedron/spherical pattern as described hereinbefore for a triangular 320 dimple pattern. The outer periphery is the equator 50 of the ball. In accordance with the present invention, dimples 52 are equilateral triangles, dimples 54 are isosceles triangles and dimples 56 are triangles of all unequal sides.

Fret 58 measures between about 0.015 inches and about 0.010 inches. When the fret between each dimple measures about 0.015 inches, about 81% of the golf ball's surface is covered with triangular dimples. When the fret between the triangular dimples is decreased to about 0.010 inches, then the percentage of coverage of the surface of the golf balls increases to about 87%. It is preferred in this embodiment that the fret, whether it be about 0.015 inches or about 0.010 inches, be uniform across the surface of the ball. It will be clear to those of skill in the art that the fret area can be greater than about 0.015 inches and yet still obtain a coverage less than about 81% and greater than about 78%.

A dimple, as used in the specification and claims and as used in the golf industry, is a standard term well-known to those of skill in the art.

Figure 5:
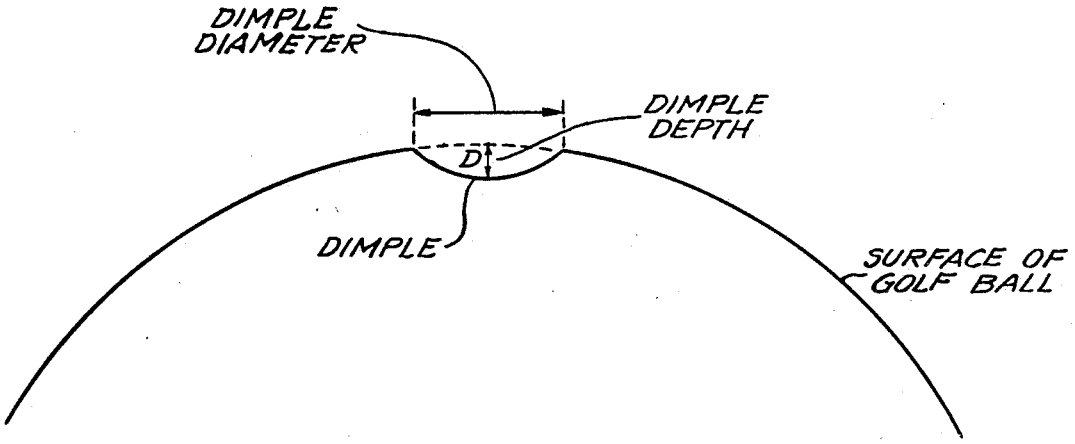
FIG. 5 illustrates a cross-section of a dimple according to the present invention.

When referring to a dimple diameter, the term "diameter" as used herein means the diameter of a circle defined by the edges of the dimple. When the edges of a dimple are non-circular, the diameter means the diameter of a circle which has the same area as the area defined by the edges of the dimple. When the term "depth" is used herein, it is defined as the distance from the continuation of the periphery line of the surface of the golf ball to the deepest part of a dimple which is a section of a sphere. When the dimple is not a section of a sphere, the depth in accordance with the present invention is computed by taking a cross section of the dimple at its widest point. The area of the cross section is computed and then a section of a circle of equal area is substituted for the cross section. The depth is the distance from the continuation of the periphery line to the deepest of the section of the circle. FIG. 5 illustrates the cross-section of a dimple along with the preferred embodiment of the present invention.

Fret, or surface area of a golf ball not covered by dimples is calculated by the following formula.

$$\pi\left[D^2 - \frac{(N)(d^2)}{4}\right]$$

where:

D = diameter of ball

N = number of dimples d = diameter of dimple

The above formula is an excellent approximation to the exact formula:

$$\pi D^2 - N\pi Dh$$

$$\text{where: } h = \frac{D}{2} - \sqrt{\left(\frac{D}{2}\right)^2 - \left(\frac{d}{2}\right)^2}$$

It will be understood that the term "about" modifies each and every number and/or measurement that appears in the claims herein if such modifier is not specifically stated in the claims herein.

It will be understood that the claims are intended to cover all changes and modifications of the preferred embodiments of the invention herein chosen for the purpose of illustration, which do not constitute departure from the spirit and scope of the invention.

What is claimed is:

1. A golf ball having dimples comprising at least 78% of the surface area of the golf ball covered by said dimples, said dimples being divided into at least two sets of dimples, a first set of dimples having an identical nominal dimple diameter and a second set of dimples having an identical nominal dimple diameter, the first set of dimples having a diameter smaller than the diameter of the second set of dimples, the golf ball being selected from the group of golf balls having a total number of dimples consisting of: 414 and 422.

2. A golf ball having 414 dimples said 414 dimples being divided into two sets of dimples comprising a first set of dimples wherein each dimple has a nominal dimple diameter of 0.140 inches and a second set of dimples wherein each dimple has a nominal dimple diameter of 0.150 inches.

3. The golf ball of claim 2 wherein the total number of dimples is about 422.

* * * * *

UNITED STATES PATENT AND TRADEMARK OFFICE

CERTIFICATE OF CORRECTION

PATENT NO. : 4,960,283

DATED : October 2, 1990

INVENTOR(S) : William Gobush

It is certified that error appears in the above-identified patent and that said Letters Patent is hereby corrected as shown below:

Column 1, line 10, after "abandoned" insert --,--;

Column 1, line 11, change "19883" to --1983--;

Column 1, line 17, change "U.S." to --United States--;

Column 1, line 44, change "2501∝253" to --250-253--;

Column 4, line 28, after "dimple" insert --configuration--;

Column 4, line 30, change "for" to --of--;

Column 4, line 33, change "for" to --of--;

Column 4, lines 37-38, delete "pattern for 484 pattern" and substitute therefor --configuration for a 484 pattern--;

Column 4, line 48, change "6herein" to --6A herein--;

Column 4, lines 49-50, change "icosahedron/ spherical" to --icosahedron/spherical--;

Column 4, lines 58-59, change "icosahedron/ spherical" to --icosahedron/spherical--;

Column 4, lines 67-68, change "icosahedron/ spherical" to --icosahedron/spherical--;

UNITED STATES PATENT AND TRADEMARK OFFICE

CERTIFICATE OF CORRECTION

PATENT NO. : 4,960,283

DATED : October 2, 1990

INVENTOR(S) : William Gobush

It is certified that error appears in the above-identified patent and that said Letters Patent is hereby corrected as shown below:

Column 5, lines 8-9, change "icosahedron/ spherical" to --icosahedron/spherical--;

Column 7, line 51, delete "manufactured from a two piece golf ball with" and substitute therefor --manufactured with a two-piece golf ball construction having--;

Column 8, line 68, change "duel" to --dual--;

Column 9, lines 15-20, delete the table shown and substitute the following table:

| | | | |
|---|---|---|---|
| Resin | | | 76.2% |
| | Resin composed of: | | |
| | Transpolyisoprene | 84% | |
| | Natural Rubber | 16% | |
| Filler | | | 22.5% |
| Other | | | 1.3% |

Column 9, line 28, change "surfaces" to --surface--;

Column 9, lines 52-59, delete the table shown and substitute the following table:

| | | | |
|---|---|---|---|
| Resin | | | 76.7% |
| | Resin composed of: | | |
| | Transpolyisoprene | 100% | |
| | Natural Rubber - | 0% | |
| Filler | | | 22.0% |
| Other | | | 1.3% |

UNITED STATES PATENT AND TRADEMARK OFFICE

CERTIFICATE OF CORRECTION

PATENT NO. : 4,960,283

DATED : October 2, 1990

INVENTOR(S) : William Gobush

It is certified that error appears in the above-identified patent and that said Letters Patent is hereby corrected as shown below:

Column 10, line 9, after "illustrates" insert --a--;

Column 10, line 22, change "2353.0-253.5" to --253.0-253.5--;

Column 10, line 32, change "Carrying" to --Carry--;

Column 10, line 48, change "a" to --as--;

Column 10, line 64, change "Launch" to --launch--;

Column 11, line 26, change "0.0160" to --0.160--;

Column 11, line 30, change "examples" to --example--;

Column 11, line 37, change "The" to --This--;

Column 13, line 4, after "deepest" insert --part--;

Column 13, line 8, after "dimples" insert --,--;

UNITED STATES PATENT AND TRADEMARK OFFICE

CERTIFICATE OF CORRECTION

PATENT NO. : 4,960,283

DATED : October 2, 1990

INVENTOR(S) : William Gobush

It is certified that error appears in the above-identified patent and that said Letters Patent is hereby corrected as shown below:

Column 14, line 20, after "dimples" insert --,--.

Signed and Sealed this

Twenty-first Day of April, 1992

*Attest:*

HARRY F. MANBECK, JR.

*Attesting Officer*

*Commissioner of Patents and Trademarks*